United States Patent [19]

Boyeson

[11] 4,062,331

[45] Dec. 13, 1977

[54] TWO CYCLE INTERNAL COMBUSTION ENGINE

[75] Inventor: Eyvind Boyeson, Kempton, Pa.

[73] Assignee: Performance Industries, Inc., Kempton, Pa.

[21] Appl. No.: 674,102

[22] Filed: Apr. 6, 1976

Related U.S. Application Data

[63] Continuation-in-part of Ser. No. 586,138, June 11, 1975, which is a continuation-in-part of Ser. No. 375,065, June 29, 1973, Pat. No. 3,905,340, which is a continuation-in-part of Ser. No. 361,407, May 8, 1973, abandoned, which is a continuation-in-part of Ser. No. 282,734, Aug. 22, 1972, abandoned.

[51] Int. Cl.[2] ..... F02B 33/04

[52] U.S. Cl. ..... 123/73 B; 123/73 A; 123/73 PP

[58] Field of Search ..... 123/73 R, 73 A, 73 B, 123/73 PP, 73 SP, 74 R, 74 A

[56] References Cited

U.S. PATENT DOCUMENTS

| | | | |
|---|---|---|---|
| 3,107,659 | 10/1963 | Steinlein et al. | 123/73 R |
| 3,382,857 | 5/1968 | Foster | 123/73 R |
| 3,612,014 | 10/1971 | Tenney | 123/73 R |
| 3,687,118 | 8/1972 | Nomura | 123/73 R |
| 3,749,067 | 7/1973 | Kobayashi et al. | 123/73 A |
| 3,797,467 | 3/1974 | Tenney | 123/73 AA |
| 3,817,227 | 6/1974 | Onishi | 123/73 R |
| 3,881,454 | 5/1975 | Jaulmes | 123/73 R |
| 3,905,340 | 9/1975 | Boyesen | 123/73 A |
| 3,905,341 | 9/1975 | Boyesen | 123/73 R |

*Primary Examiner*—Ronald H. Lazarus
*Assistant Examiner*—David D. Reynolds
*Attorney, Agent, or Firm*—Synnestvedt & Lechner

[57] ABSTRACT

A two-cycle internal combustion engine having reed-type intake valving, and specially configured and positioned intake and injection porting, with the porting constructed and arranged to improve various of the operating characteristics of the engine.

21 Claims, 6 Drawing Figures

11a
13a
10a
4
14a
21a
30a
TDC
4
19a
29a
27a
22a
35
BDC
14'
34a
12a
20a 31a
19a
30a
10a
11a
13a
32a
29a
23a
27a
3
28a
14a
29a
21a
23a
3
27a
19a
30a
32a
22a
31a 11b
39
21b
36
36'
6
14b
TDC
6
13b
29b
W
37
27b
19b
22b
38
BDC
30b
13b
12b
40
13b 19b
30b
W
11b
39
14b
29b
23b
27b
5
28b
5
13b
29b
23b
27b
19b
30b
22b

TWO CYCLE INTERNAL COMBUSTION ENGINE

The present application is a continuation-in-part of my application Ser. No. 586,138, filed June 11, 1975, which in turn is a continuation-in-part of my application Ser. No. 375,065, filed June 29, 1973, which in turn is a continuation-in-part of my prior application Ser. No. 361,407, filed May 18, 1973, now abandoned, which is a continuation-in-part of my prior application Ser. No. 282,734, filed Aug. 22, 1972, now abandoned. Said application Ser. No. 375,065 has now matured as patent 3,905,340. Applications bearing Ser. Nos. 416,213, and 416,215, filed November 15, 1973, are divisions of Ser. No. 375,065 and, said application Ser. No. 416,215 is not U.S. Pat. No. 3,905,341, and said application 416,213 is now U.S. Pat. No. 4,000,723.

As in my prior patents and applications just identified, the present invention has the general objective of improving the performance, power output, flexibility, response and fuel economy of internal combustion engines, especially two-cycle, variable speed, crankcase compression engines as used for a variety of purposes, for example on motorcycles.

While having important features in common with certain of the prior patents and applications identified above, the present application contemplates alternative arrangements and further improvements as compared with my prior patents and applications, as is more fully explained hereinafter with reference to the drawings of the present application.

BACKGROUND OF THE INVENTION

In considering some of the major general objectives of the invention it is first noted that performance characteristics of engines, and especially of two-cycle engines, are determined in large part by the fuel intake capabilities, which are in turn governed by the total cross-sectional area of the intake passages, the length and the directions of the path of flow of the incoming fuel, the duration of the intake, the portion of the cycle during which intake occurs, and the responsiveness of the action of the intake valves. With these features in mind the present invention, and the inventions of my above-identified patents and applications, provide novel arrangements and interrelationships of intake porting and reed valves which mutually contribute to an increase in the cross-sectional intake flow area for the fuel, and to an extension of the portion of the cycle during which intake of fuel occurs, and which shorten and make more direct the flow path of the incoming fuel.

The features of the present invention which contribute to the foregoing general objectives are explained in detail below. However, it is first noted that a brief description of the prior art in this field is included in my prior patents and applications. In this connection see for example the description in my U.S. Pat. No. 3,905,340. For the purposes of the present disclosure, the following brief additional discussion will be helpful as background material.

Important aspects of my developments, disclosed and claimed in my earlier cases, particularly in U.S. Pat. No. 3,905,341 and in application Ser. No. 586,138, have to do with what I have referred to as "injector" ports, and with the fact that such ports may advantageously be used in combination with other novel intake porting and with the passages commonly used in the industry to transfer the compressed fuel mixture from the crankcase to the combustion side of the piston.

In certain figures of drawings common to my application Ser. No. 586,138 and to U.S. Pat. No. 3,905,341, FIGS. 9 and 10 disclose the novel use of injector ports, while FIG. 11 represents, graphically, the improvements, in power curve which are achievable by utilizing one form of injector porting. FIGS. 12 and 13 of my copending application Ser. No. 568,138 disclose another improvement in injector porting. While these several arrangements have yielded very beneficial results, I have been able to devise apparatus for utilizing injector ports, and novel transfer and intake porting, to still greater advantage, as will now be explained.

SUMMARY OF THE INVENTION

Broadly, it is the objective of this invention to maximize the power output in two stroke engines, and to broaden the power band.

It is also an object of the present invention to optimize the intake of fuel into the space below the piston which communicates with the crankcase, by utilizing intake porting configured and positioned to provide the introduction of fuel just beneath the piston and into said space throughout the entire stroke of the piston, from substantially the bottom dead center position to substantially the top dead center position thereof, and to provide such extended intake augmented by the use of injector porting so connected to both the intake and the transfer passages as to draw fuel from the intake chamber and supply it directly to the transfer passage.

In one aspect of the invention, both injector and intake porting are made in the simplest possible manner, taking the form of a cavity provided in the cylinder wall and openly facing the outer side portion of the piston.

The invention also contemplates reduction of deleterious turbulence by providing intake, transfer, and injector porting so configured and communicating as to promote very smooth mixing of fuel derived from the crankcase with that derived from the fuel intake.

As a result of all these improvements it has been possible, to provide machines of such power output — for a given cubic capacity of the engine — as to insure greater acceleration from a standing start, than is achieved by other machines in the racing field.

To the foregoing general ends I provide, and disclose and claim herein, three improved arrangements in each of which the injector ports are used in combination with reed valving and intake porting, uniquely configured and positioned to provide for introduction of fuel immediately beneath the piston, and thence into the crankcase, throughout the entire upward stroke of the piston, from substantially its bottom dead center position to substantially its top dead center position. This arrangement, in combination with my unique injector ports which draw fluid from the intake chamber and supply it directly to the transfer passages (which latter are also feeding to the combustion chamber fuel compressed in the crankcase), optimizes fuel delivery throughout the cycle, and thereby maximizes power.

Some of the advantages of this apparatus are achieved by my previous engines, which were improvements in the type of prior art engines in which the piston is used to block not only the transfer ports, but also the intake porting. In addition to the use of injector porting, my earlier improvements contemplated engines in which the piston skirt is apertured to provide piston porting which registers with the intake porting, and thus fuels the engine, when the piston would otherwise be blocking the intake, for example at bottom dead center position.

Such previous improvements, while advantageous, have provided less than optimum fuel induction, and the apertures in the piston skirt, under the crown of the piston, have at times had a tendency to weaken the piston, with risk of consequent increased wear of both the piston and the cylinder.

I have been able to obviate these difficulties by providing a reed valve engine using my injector porting in combination with intake porting disposed high in the cylinder, and yet having sufficient dimension, in the direction of the cylinder axis, to insure introduction of fuel just beneath the piston even at the start of the upward stroke thereof and preferably continuing throughout the entire upward stroke thereof.

The significance of these improvements will be better appreciated when it is understood that prior art apparatus, has been influenced by an over-emphasis on the compression of fuel in the crankcase, during the downward portion of the piston stroke. There is, of course, elevation of pressure in the crankcase. However, this is not the most important consideration, particularly since the crankcase volume is substantially occupied by the crankshaft, connecting rod, and counterweight. The developmental work which has led to my inventions has been predicated upon recognition of the fact that, as the piston moves upward in the cylinder, there is instantaneous creation of a void immediately under the piston crown, and that this void, at top dead center position is of considerable volume, particularly in engines of larger displacement. Accordingly, I have recognized that the reed valving which provides for fuel feed will operate most efficiently, to introduce a charge available for transfer, if the valving and its cylinder intake porting is located high enough in the cylinder to permit the introduction of fuel immediately beneath or close to the piston, even at the start of the upward stroke and throughout its entire upward stroke. By suitable extension of the intake porting, it is possible, and advantageous, to introduce fuel, beneath the inlet edge of the piston, even at bottom dead center position and throughout the entire upward stroke. Considered from another point of view, I have provided a reed cage which is located much higher in the cylinder than has previously been the practice, said cage being in direct confrontation with the piston, and I have utilized such reed cage in conjunction with confronting intake porting of substantial vertical dimension.

With the foregoing in mind, in a particularly advantageous engine with these features, I provide intake porting which has a dimension, in the direction of the cylinder axis, equal to and preferably slightly greater than the length of the piston stroke.

As will become apparent as the description proceeds, my improved apparatus is also featured by virtual elimination of the short circuiting of fuel which has occurred in certain engines. For example, in certain engines using booster, or so-called "auxiliary scavanging" passages, there has been a loss of efficiency as a result of some of the fuel, inletted into the cylinder through the transfer porting, flowing back through the booster passage and into the intake area when the piston is close to the bottom dead center position.

In certain of the embodiments described hereinafter, the injector and intake porting have portions in common, which portions are comprised, at least in major part, by cavities recessed in the wall of the cylinder liner or other housing, and openly confronting outside surface portions of the piston.

How the foregoing and other objects and advantages ae achieved, will be clear from the following detailed description referring to the accompanying drawings, in which.

DETAILED DESCRIPTION OF THE ILLUSTRATED EMBODIMENTS

Figure 1:
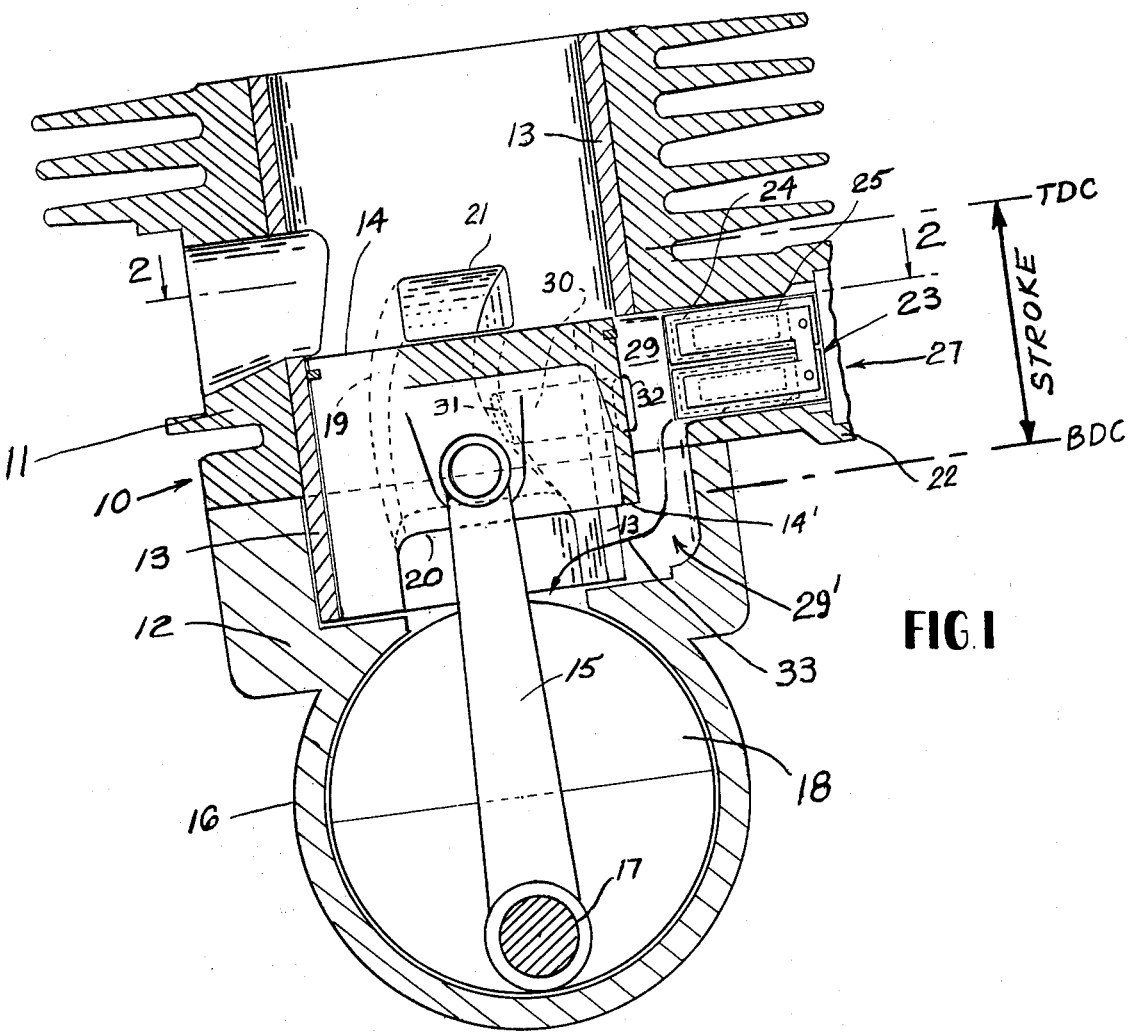
FIG. 1 is a view in section, taken along the line 1—1 of FIG. 2, and illustrating an two-cycle reed valve engine having intake and injector porting characteristic of this invention.
Figure 2:
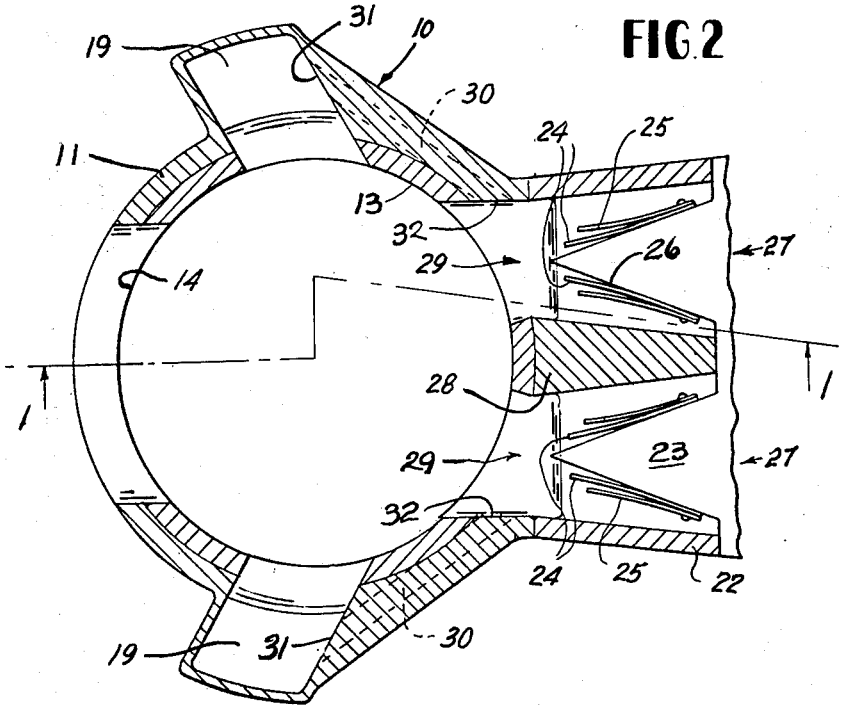
FIG. 2 is a sectional view taken along the line 2—2 of FIG. 1.

First making reference to the embodiment of FIGS. 1 and 2, there is shown a somewhat diagrammatic representation of a two-cycle piston engine comprised of a housing 10 the upper portion of which defines a cylinder 11 and the lower portion of which defines a crankcase 12. The upper, annular portion of the crankcase interfits with cylinder liner structure 13, which extends throughout the height of the cylinder 11, except where omitted or removed to provide certain porting, and projects beneath it in the manner plain from FIG. 1. While the use of a liner is preferred it is not essential, and for most purposes of the present invention the liner can be considered as a part of the cylinder 11, which, in turn, forms the upper portion of housing 10. A piston 14 is mounted for reciprocation within the cylinder and its connecting rod 15 is eccentrically mounted upon the crankshaft within the lower portion 16 of the crankcase, as indicated at 17. As is conventional, a semi-circular counterweight is preferably employed, as shown at 18. The cylinder 11 includes transfer passages 19, the lower end of each of which is in open communication with the crankcase and the upper end of each of which terminates in a port opening through the cylinder wall and into the space lying to the combustion side of piston 14. As will be understood, it is preferred to employ at least two such transfer passages (see FIG. 2) and one thereof appears in FIG. 1 at 19, its lower end 20 having the stated open communication with the crankcase and its upper end terminating in the aforesaid port shown at 21. Conveniently, and as shown, the passage 19 is provided in the wall of cylinder 11, lying behind the liner 13, which is apertured to provide the lower communication at 20 as well as the upper port 21. As is conventional, combustable gases inletted during the upward stroke are pressurized beneath the piston and in the crankcase, by the piston throughout its downward stroke toward the bottom dead center position illustrated, and the gases flow from the crankcase through space 20, passages 19 and ports 21, from whence the gases enter the cylinder above the piston 14.

The cylinder 11 also includes an intake chamber 22 which leads to a source of fuel (not illustrated) and which chamber contains the reed valve means 23, which is adapted to open and provide for intake of fuel throughout the entire upward stroke of the piston, and to close, during the downward stroke of the piston, when the fuel inletted into the space below the piston is compressed. While, for the purposes of the present invention, the reed valve means 23 may take a variety of forms known in the art, it is preferred that said reed valve means be of the so-called "vented" type described and claimed in my earlier disclosures and particularly in U.S. Pat. No. 3,905,340, to which reference may be had for a more detailed description. For the purposes of the present description, it is sufficient to point out that each such preferred reed valve assembly comprises primary and secondary reeds 24 and 25, respectively, (see particularly FIG. 2), and that these reeds are mounted upon a generally triangular valve cage or body 26 (FIG. 2) which includes an apex preferably extending generally in the direction of the axis of the cylinder. The valve body 26 is apertured, as is clear from the disclosure of U.S. Pat. No. 3,905,340, and the primary reed 24 is also apertured, or vented, providing an opening across which the secondary reed extends, all as fully described and claimed in said patent.

It is preferred that the intake chamber 22 be divided into a pair of parallel intake passages 27,27, separated by a partition or wall 28, which aids in directing the intake flow through the channels 27 and into the crankcase through spaced intake porting shown at 29,29. This intake porting cooperates with injector ports 30,30, one end 31 of each port communicating with the transfer passage 19, and the other end 32 of each port (see particularly FIG. 1) terminating in the intake porting 29.

In particular in accordance with the present invention, the reed valving is mounted high in the cylinder, confronting the piston, and the intake porting is configured and positioned to provide for introduction of fuel immediately beneath the piston 14 throughout the entire upward stroke of the piston from its bottom to its top dead center position. The reed valves and the lower edge of the piston skirt, in my apparatus, are in such relationship that they confront each other when there is maximum piston speed (mid stroke), and hence maximum suction beneath the piston. As viewed in FIG. 1, it will be seen that the right side of the piston terminates in a generally horizontal inlet edge 14' and that this edge lies along the line identified as BDC, at the bottom dead center position, and along the line identified as TDC, at the top dead center position. The length of the stroke is, of course, the distance between BDC and TDC.

As explained above, it is a substantial advantage not only to have the fuel inletted substantially directly radially of the engine, as shown in FIGS. 1 and 2, but also that the intake porting be located relatively high in the cylinder to insure flow of fuel into the area immediately beneath the piston throughout the entire upward stroke when the reed valves are open. This porting arrangement together with the closely arranged and substantially directly radially confronting reed valve, shortens the fuel flow path and this is also of importance in maximizing the fuel intake.

In providing the spaced intake porting 29, which confronts the reed valving I have opened the cylinder and the upper part of the crankcase structure sufficiently, as seen at 29', to give the intake porting a dimension, in the direction of the cylinder axis (the sum of the vertical dimensions at 29 and 29'), sufficient to insure flow of fuel throughout the entire upward stroke. In the illustrated engine, and as is preferable, I have provided intake porting 29,29' in which the mentioned dimension is substantially equal to and preferabely slightly greater than the length of the piston stroke, as is apparent from FIG. 1. For this purpose, even when the piston 14 is at the bottom dead center position illustrated in FIG. 1, in which the top of the intake porting is at the top of the piston, fuel flows from the intake chamber downwardly through intake porting 29', past the lower edge 14' of the piston and into the space immediately below said piston, as indicated by the arrow designating such flow and identified at 33.

As indicated above, two injector passages of the kind illustrated at 30 extend through the cylinder wall and each has one end portion thereof communicating with the transfer passage at 31 and its opposite end 32 communicating with the intake porting 29. These injector passages are similar to passages described and claimed in U.S. Pat. No. 3,905,341, are open throughout the complete cycle and serve to increase intake of fuel at higher RPM, especially above 6,000 to 7,000 RPM. When the charge contained in the crankcase 16 is pressurized by the descending piston 14, such charge flows upwardly through the transfer passages 19 to the transfer ports 21 and into the cylinder. This flow takes place at high velocity and, in accordance with Bernoulli's Principle, the rapidly moving charge in the passage 19 causes an eductor effect in the injector port 30 which, in turn, causes relatively low pressure to exist in such port. Accordingly, fuel charge is drawn from the intake tract downstream from the valve assembly, through the injector ports 30, and into the transfer passages 19.

As is fully considered in U.S. Pat. No. 3,905,341, and graphically portrayed therein, the peak horsepower of an engine is raised considerably by the use of such injector porting. By employing the porting, in combination with the extended intake porting characteristic of this invention, I have found that it is possible to optimize fuel delivery throughout the cycle, and thereby to maximize power.

With reference to the orientation of the engine and reed valves as shown in FIG. 1, it should be kept in mind that in many installations, particularly in motorcycles and snowmobiles, the intake passage of a two-cycle engine, and also the engine itself, is somewhat inclined in a direction such that liquid fuel tends to flow from the carburetor (not shown) to the intake passage or chamber 22 and toward intake port 29. Such inclination is shown in FIG. 1.

Figure 3:
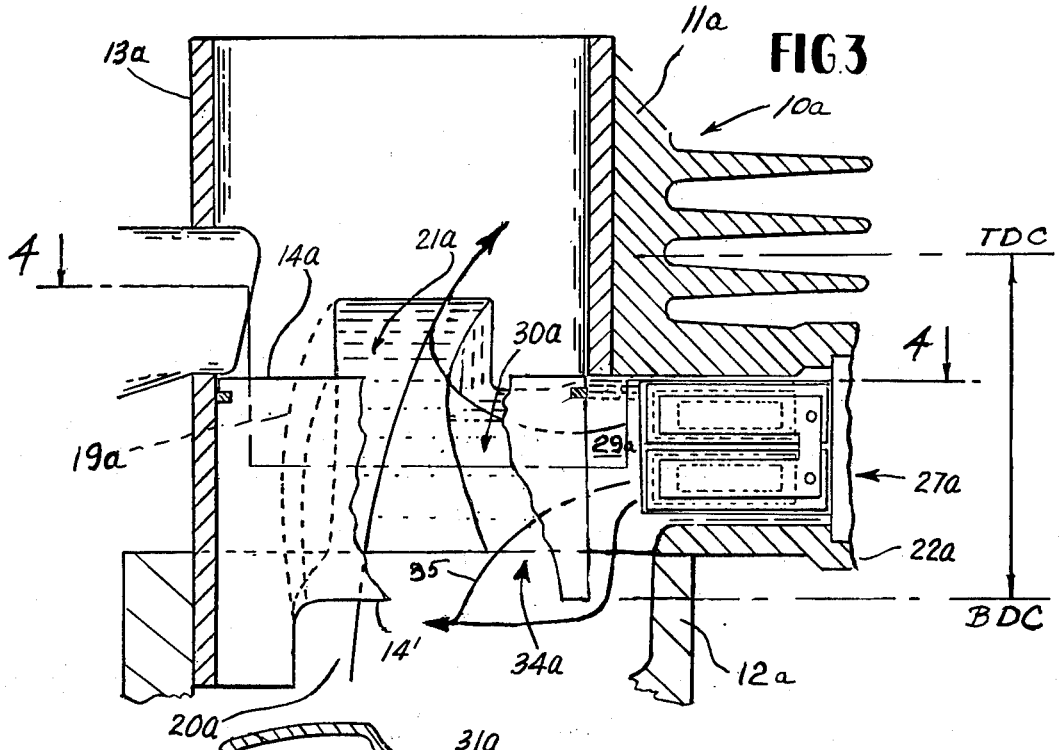
FIG. 3 is a somewhat diagrammatic sectional view generally similar to FIG. 1, but omitting the crankcase, the view being taken along the line 3—3 of FIG. 4 and illustrating another embodiment of the invention.
Figure 4:
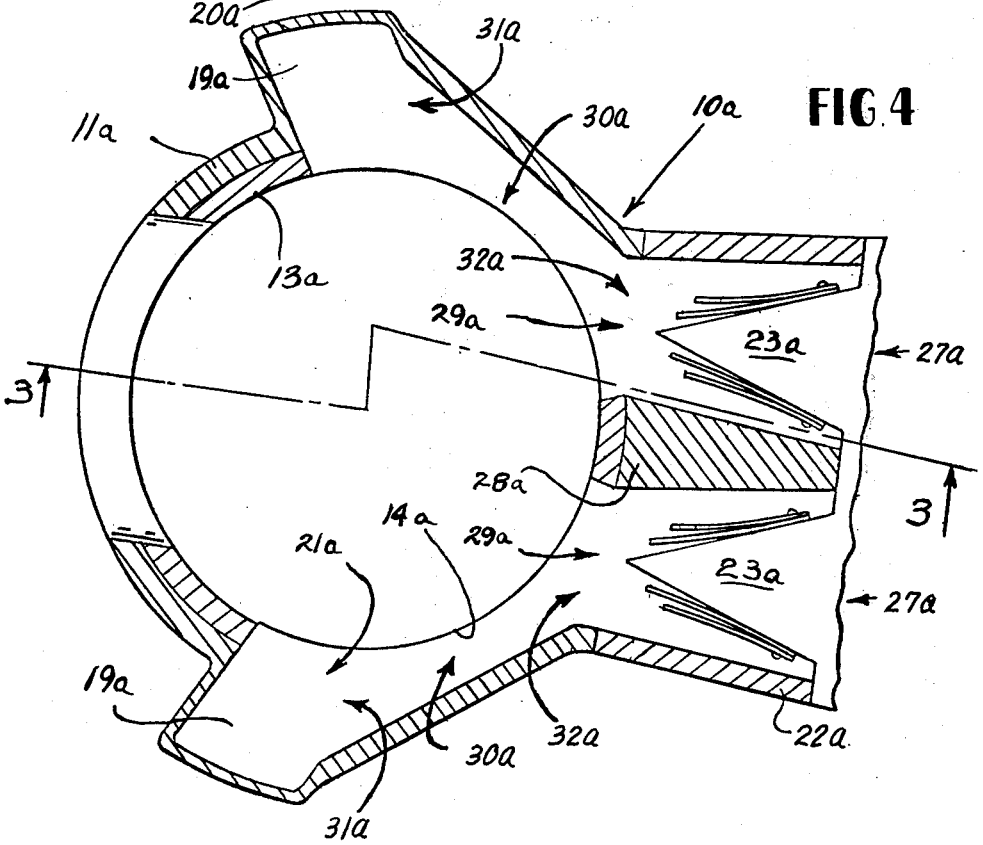
FIG. 4 is a sectional view taken along the line 4—4 of FIG. 3.

FIGS. 3 and 4 illustrate a modified form of apparatus for accomplishing the improved fuel induction of this invention. This modified form is additionally advantageous because of its simplicity in manufacture and consequent cost advantage. The intake valving and porting, in the embodiments of FIGS. 3 and 4, have the elevated location explained above and also present minimal flow obstruction, thus maximizing the induction of intake fluid and affording still greater efficiency, even as compared with the arrangement of FIGS. 1 and 2. Portions of this modified apparatus, which correspond to similarly functioning apparatus of FIGS. 1 and 2, are identified by similar reference numerals, but include the subscript *a*. Thus it will be seen that the housing **10*a* defines a cylinder 11*a* which has a liner 13*a* within which there is mounted a piston 14*a*. While the crank is not illustrated and the crankcase only fragmentarily at 12*a***, they should be understood as being essentially similar to the apparatus shown in FIG. 1.

As is the case with the embodiment of FIGS. 1 and 2, two passages which serve the injector function are provided in the modified arrangement. These passages are shown at 30*a*, 30*a*, and each is arranged at a substantial angle with respect to the axis of the adjacent transfer passage 19*a*, which terminates in the transfer port 21*a*. As will be appreciated, the port 21*a* of each transfer passage lies above the piston 14 when the latter, as shown fragmentarily in FIG. 3, occupies its bottom dead center position (BDC). An intake chamber 22*a* and reed valve apparatus 23*a*, together with divided intake passages 27*a*,27*a* are used in essentially the same manner as already mentioned with regard to the embodiment of FIGS. 1 and 2, and as is fully disclosed and claimed in said U.S. Pat. No. 3,905,340.

In the embodiment of FIGS. 3 and 4, the injector porting 30*a*,30*a* takes the form of a pair of cavities each recessed in the wall of the cylinder in a position in which its open side confronts an outer side wall portion of the piston 14*a*. This confrontation clearly appears in the sectional showing of FIG. 4, the piston appearing in full line. Cavity 30*a* is simpler to provide than the injector passages 30 of FIGS. 1 and 2, which latter passages are completely enclosed by the metal of the cylinder and its liner. The open construction facilitates casting of the cylinder, making possible the employment of injector passages of larger cross section, and promotes smoother fluid flow. The outer side wall of piston 14*a* provides the inner wall limit (considered radially of the cylinder) of each injector port 30*a*, as appears in FIG. 4. Each of the resultant cavities 30*a* provides one of the injector passages, and each interconnects one of the intake ports 29*a* with one of the transfer passages, as at 31*a*.

As described with reference to the earlier embodiment, the rapidly moving charge in the passage 19*a*, flowing past the open end 31*a* (FIG. 4) of injector passage 30*a* causes low pressure to prevail throughout the injector passage or cavity. This low pressure is communicated to the intake tract through the open passage extending in the region 32*a*, and there is achieved a horsepower advantage similar to that already mentioned with reference to FIGS. 1 and 2. It is to be noted that the intake porting 29*a*, which includes a downwardly curved cavity region 34*a* (FIG. 3) is of sufficient height, as compared with the length of the stroke, to afford entrance of fuel beneath the piston inlet edge 14', even in the BDC position illustrated in FIG. 3. A flow arrow designated 35 in FIG. 3, shows entrance of the intake fluid from the region 29*a*, down through the cavity, including cavity region 34*a*, to the region beneath the piston which communicates with the crankcase.

Figure 5:
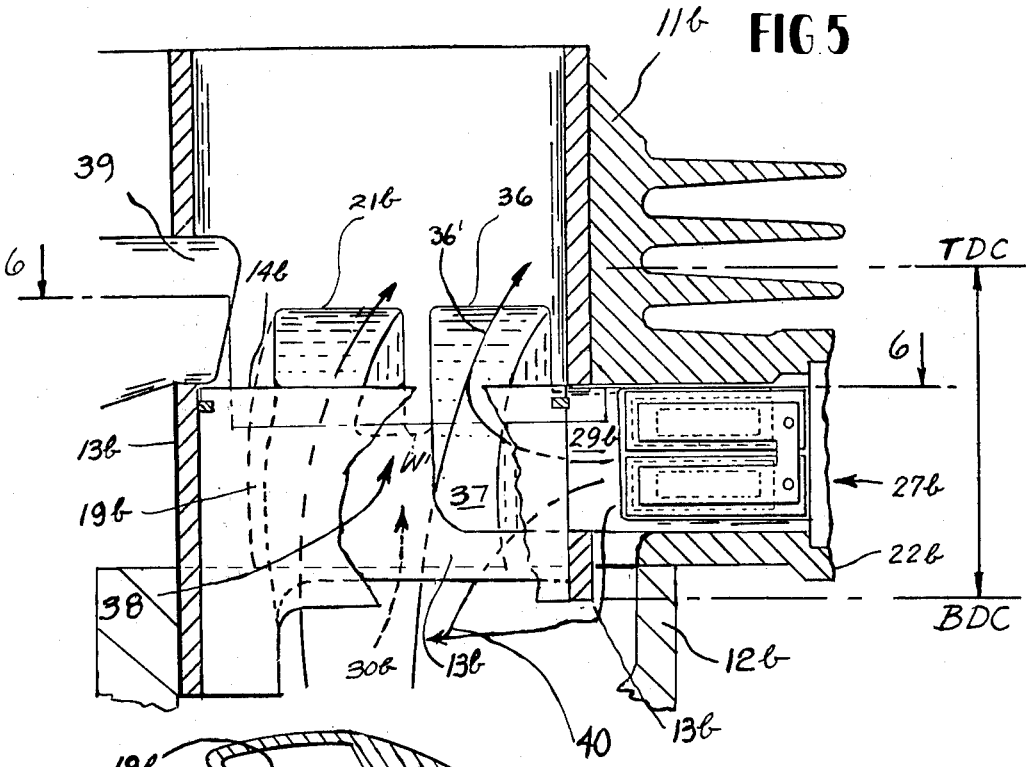
FIG. 5 is a view similar to FIG. 3, taken along the line 5—5 of FIG. 6, and illustrating a third embodiment of the invention.
Figure 6:
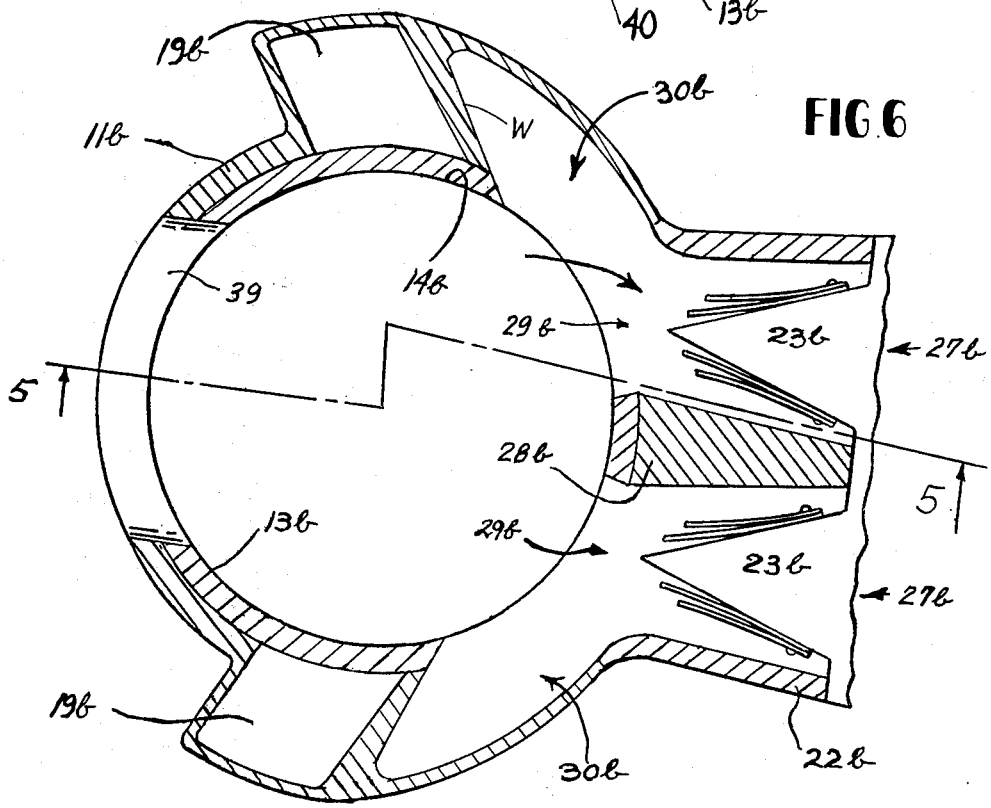
FIG. 6 is a sectional view of the apparatus of FIG. 5 taken along the line 6—6 of FIG. 5.

Turning to FIGS. 5 and 6, in which similar parts bear similar reference numerals including the subscript *b*, it will be seen that this third embodiment also utilizes injector porting which comprises a pair of passages 30*b*,30*b* formed by removing portions of liner 13*b* and of cylinder structure 11*b*. Again each injector passage 30*b* comprises a cavity in the cylinder and liner, and interconnects the intake porting 29*b* with the transfer passage 19*b*.

In this embodiment, instead of employing only a single transfer port and passage at each side of the cylinder, a pair of adjacent ports are employed, each opening separately into the combustion space of the cylinder, as seen most clearly in FIG. 5. These ports are the transfer port 21*b* and an auxiliary inlet port 36 which has a dual function serving the purposes of a transfer port (see the flow arrow 36') and which also is fed directly from the intake porting 29*b* through the cavity region just beneath the auxiliary port 36. As is revealed by the brokenaway central portion of the piston in FIG. 5, a cavity portion 37 opens directly through the wall of liner 13*b*, while another adjacent cavity portion 38 is formed in the cylinder behind the liner. These cavity portions 37 and 38, together comprise an injector passage 30*b*, the cavity portion 37 serving also as a means for directly feeding the port 36 in its auxiliary inlet function. Thus the auxiliary port 36 is in free communication not only with the injector passage 30*b* (formed by cavity portions 37 and 38), but also with the transfer passage 19*b*, and its port 21*b*. Wall W lying between the ports 21*b* and 36 supports the piston, in the region of those ports, but this wall terminates at $W^1$, as shown in FIG. 5, just below the plane of section line 6—6, leaving the cavity portions 37 and 38 in free communication with each other. As in the other embodiments, the intake porting 29*b* has vertical extent sufficient to provide fuel intake immediately below the piston, as shown by arrow 40, even when the piston is at BDC.

A particular advantage of this form of the invention lies in the fact that it eliminates short circuiting of fuel which had previously occurred in engines having transfer ports (see 21*b*), as well as auxiliary ports sometimes referred to as booster ports. Previously, fuel inletted through the transfer port has to some extent flowed back through the booster port and passage and into the intake area, with a resultant loss of efficiency. This difficulty arose in prior constructions because of the position which earlier auxiliary ports occupied with relation to the direction of fuel introduced from the transfer port into the space above the piston. To avoid premature passage of fuel out of the cylinder through the exhaust port (see the port shown at 39 in FIGS. 5 and 6) it is common to introduce fuel through the transfer port so that it flows in a direction toward that side of the cylinder which is away from the exhaust port 39. This direction of flow is indicated by the flow arrows shown extending from the port 21*a* (FIG. 3) and from the port 21*b* (FIG. 5). On the other hand the booster port was generally located in vertical alignment with the intake porting, and the result has been a tendency for the fuel to short circuit out of the transfer port, into the booster port, and thence back into the intake area.

In my new arrangement shown in FIGS. 5 and 6 the auxiliary inlet - transfer port 36 is adjacent to the main transfer port 21*b*. Since both of the ports 21*a* and 36 are augularly spaced from the intake porting, in a plane transverse the cylinder axis, both "look" in generally the same direction across the cylinder, rather than generally confronting one another. Short circuitingis therefore eliminated, since the fuel, due to its velocity and kinetic energy, does not make the 180° turn which would be required to flow from the transfer port 21*b* into the auxiliary port 36.

I claim:

1. A variable speed, two-cycle crankcase compression, internal combustion engine, comprising: engine housing structure including a cylinder and a crankcase, a skirted piston mounted for reciprocation in the cylinder between top and bottom dead center positions; at least one transfer passage in communication with the crankcase and having an opening through the cylinder wall for supplying, to the combustion side of the piston, fluid compressed in the crankcase during movement of the piston toward its bottom dead center position; a fuel intake chamber for receiving fuel from a supply source, and having intake porting in the housing structure positioned to deliver fuel to the space below the piston including the crankcase, said intake porting including portions configured and positioned to provide for introduction of fuel beneath the piston and into said space independently of the transfer passage throughout the entire upward stroke of the piston, from substantially the bottom dead center position to substantially the top dead center position thereof; reed valve means for controlling the flow of fluid through the intake chamber and substantially preventing flow of fluid back toward such supply source during downward movement of the piston toward its bottom dead center position; and injector passage means responsive to the flow of compressed fluid through said transfer passage to draw fluid from the intake chamber and supply it to said transfer passage, and directly to the combustion side of the piston without compression of the latter fluid in the crankcase, said injector passage means having porting communicating with said transfer passage and having other porting communicating with said intake chamber downstream of said reed valve means.

2. An engine in accordance with claim 1, and in which said injector passage means is also in communication with said intake porting.

3. An engine in accordance with claim 1 and further characterized in that said injector passage means comprises a generally tubular channel extending in the wall of the cylinder.

4. An engine in accordance with claim 1, and further characterized in that said injector passage means comprises, at least in major part, a cavity recessed in the cylinder wall and openly confronting outside surface portions of the piston when the latter is in the region of its bottom dead center position, whereby the recessed cylinder wall and said surface portions of said piston together define said injector passage means.

5. An engine in accordance with claim 1, and further characterized by the inclusion of a pair of transfer passages spaced substantially diametrically of the cylinder, and in which said injector passage means comprises a pair of injector passages, the porting of the passages of said latter pair respectively communicating with a corresponding one of said transfer passages.

6. An engine in accordance with claim 4, and in which said portions of said intake porting are in open communication with the cavity of said injector passage means and comprise, at least in major part, an extension of the injector passage cavity.

7. An engine in accordance with claim 6, and further including means for promoting mixing of fuel derived from said crankcase and from said fuel intake chamber, said last means comprising an opening through the cylinder wall, adjacent the mentioned transfer passage opening, and being in free communication with said transfer passage, said injector passage means, and said intake porting.

8. An engine according to claim 7, and in which said adjacent opening and said transfer passage opening are augularly spaced from said injector passage means, in a plane transverse the cylinder axis.

9. An engine according to claim 1, and further including auxiliary inlet-transfer porting in communication with said intake porting and having a fuel supply opening through the cylinder wall adjacent the transfer passage opening, the opening of said transfer passage and said auxiliary inlet-transfer porting being augularly spaced from said intake porting, in a plane transverse the cylinder axis.

10. A variable speed, two-cycle crankcase compression, internal combustion engine, comprising: engine housing wall structure including a cylinder and a crankcase, a piston mounted for reciprocation in the cylinder between top and bottom dead center positions; a pair of generally opposed transfer passages each in communication with the crankcase and each having an opening through the cylinder wall for supplying, to the combustion side of the piston, fluid compressed in the crankcase during movement of the piston toward its bottom dead center position; fuel intake means for receiving fuel from a supply source, and having intake porting in the housing structure positioned to deliver, beneath the piston and into the crankcase, fuel received from said source, said intake porting providing for such delivery of fuel independently of the transfer passages throughout the entire upward stroke of the piston, from substantially the bottom dead center position thereof to substantially the top dead center position thereof; reed valve means for controlling flow of fluid through the intake means and substantially preventing flow of fluid back toward such supply source during downward movement of the piston toward its bottom dead center position; and injector passage means responsive to the flow of fluid through said transfer passages, to draw fluid from the intake means and supply such fluid to said transfer passages and thence directly to the combustion side of the piston without compression in the crankcase, said injector passage means having porting communicating with each of said transfer passages and other porting communicating with said intake means downstream of said reed valve means.

11. An engine in accordance with claim 10, and in which said intake porting includes a portion opening through said structure wall of the cylinder and a portion opening through said wall structure of the crankcase adjacent the cylinder.

12. An engine in accordance with claim 10, and further characterized in that said injector passage means comprises a pair of generally tubular channels extending in the wall structure of the cylinder.

13. An engine in accordance with claim 10, and further characterized in that said injector passage means comprises, at least in major part, cavities formed in the housing wall structure and openly confronting outside surface portions of the piston, when the latter is in its bottom dead center position, whereby the recessed cylinder wall and said surface portions of the piston together define said injector passage means.

14. An engine in accordance with claim 10, and in which at least portions of said intake porting communicate with, and comprise a part of, said injector porting.

15. An engine in accordance with claim 13, and further characterized in that portions of said intake porting comprise extensions of the cavities which comprise said injector passage means.

16. An engine in accordance with claim 15, and further including means for promoting smooth mixing of fuel derived from said fuel intake means and from said crankcase, said last means comprising provision, adjacent each transfer passage, of an opening through the cylinder wall, adjacent each transfer passage opening, and being in free communication with said transfer passage opening, said injector passage means, and said intake porting.

17. An engine according to claim 16, in which said openings, adjacent said transfer passage openings, are augularly spaced from said intake porting, in a plane transverse the cylinder axis.

18. A variable speed, two-cycle crankcase compression, internal combustion engine, comprising: engine housing structure including a cylinder and a crankcase, a skirted piston mounted for reciprocation in the cylinder between top and bottom dead center positions; at least one transfer passage in communication with the crankcase and having an opening through the cylinder wall for supplying, to the combustion side of the piston, fluid compressed in the crankcase during movement of the piston toward its bottom dead center position; a fuel intake chamber for receiving fuel from a supply source, and having intake porting in the housing structure positioned to deliver fuel to the space below the piston including the crankcase, said intake porting including portions configured and positioned to provide for introduction of fuel beneath the piston and into said space throughout the entire upward stroke of the piston, from the bottom dead center position to the top dead center position thereof; reed valve means for controlling the flow of fluid through the intake chamber and substantially preventing flow of fluid back toward such supply source during downward movement of the piston toward is bottom dead center position; and auxiliary inlet-transfer porting in communication with said intake porting and having a fuel supply opening through the cylinder wall adjacent the transfer passage opening, said openings of said transfer passage and said auxiliary inlet-transfer porting being adjacent, and angularly spaced from said intake porting in a plane transverse the cylinder axis.

19. A variable speed, two-cycle crankcase compression, internal combustion engine, comprising: engine housing structure including a cylinder and a crankcase, a piston mounted for reciprocation in the cylinder between top and bottom dead center positions; at least one transfer passage in communication with the crankcase and having an opening through the cylinder wall for supplying, to the combustion side of the piston, fluid compressed in the crankcase during movement of the piston toward its bottom dead center position; a fuel intake chamber for receiving fuel from a supply source, and having intake porting in the housing structure positioned to deliver fuel beneath the piston; and reed valve means for controlling the flow of fluid through the intake chamber substantially radially of the cylinder, said reed valve means being aligned with said intake porting and, together with said intake porting, confronting the side of said piston when the latter is in its bottom dead center position, said intake porting having a dimension, in the direction of the axis of the cylinder, substantially equal to the length of the piston stroke, whereby fuel from said intake porting is delivered beneath the piston throughout the upward stroke of the latter, from its bottom dead center position to its top dead center position.

20. An engine in accordance with claim 19 in which the mentioned dimension of said intake porting is greater than the length of the piston stroke.

21. An engine in accordance with claim 19 in which the upper edge of the intake port is located at the upper edge of the piston when the piston is in the bottom dead center position.

* * * * *